United States Patent [19]

Hukuda et al.

[11] 4,408,861

[45] Oct. 11, 1983

[54] TRANSFER-PRINTING SHEET SEPARATING SYSTEM FOR ELECTROPHOTOGRAPHIC COPYING APPARATUS

[75] Inventors: Minolu Hukuda, Kawasaki; Tsutomu Watanabe, Yokohama, both of Japan

[73] Assignee: Ricoh Co., Ltd., Japan

[21] Appl. No.: 181,054

[22] Filed: Aug. 25, 1980

[30] Foreign Application Priority Data

Aug. 31, 1979 [JP] Japan ..... 54-119134[U]
Oct. 30, 1979 [JP] Japan ..... 54-140184
Nov. 14, 1979 [JP] Japan ..... 54-147547

[51] Int. Cl.[3] ..... G03G 15/00; G03G 15/14

[52] U.S. Cl. ..... 355/3 TR; 271/274; 271/312; 271/DIG. 2; 355/3 SH; 355/14 SH

[58] Field of Search ..... 355/3 R, 3 TR, 3 SH, 355/3 TE, 14 TR, 14 SH; 271/242, 273, 274, 307, 312, DIG. 2

[56] References Cited

U.S. PATENT DOCUMENTS 3,687,539 8/1972 Furuichi ..... 355/3 R X
4,060,230 11/1977 Church et al. ..... 271/312
4,065,121 12/1977 Siletto et al. ..... 271/312 X
4,091,137 5/1978 Miller ..... 428/198
4,214,833 7/1980 Kono ..... 355/3 TR X
4,219,376 8/1980 Roman ..... 428/156 X
4,327,991 5/1982 Takeuchi et al. ..... 355/3 SH

*Primary Examiner*—Fred L. Braun
*Attorney, Agent, or Firm*—McGlew and Tuttle

[57] ABSTRACT

A transfer-printing sheet separating system including a device for bending the leading end portion of a transfer-printing sheet having a pair of rotary members interposed between a sheet feeding device and a transfer-printing station near the periphery of a photosensitive member and disposed on opposite sides of the path of travel of the transfer-printing sheet, and a separating member disposed downstream of the transfer-printing station with respect to the direction of travel of the transfer-printing sheet and having a forward end spaced apart from the periphery of the photosensitive member a predetermined distance. The transfer-printing sheet has its leading end portion bent or curved before being fed to the transfer-printing station, and separated from the periphery of the photosensitive member by the separating member after a toner image is printed thereon. Rotation of the rotary members may be temporarily stopped or a pair of registration rollers may be used for obtaining registration of the leading end of the transfer-printing sheet with the leading end of the toner image on the periphery of the photosensitive image at the transfer-printing station.

4 Claims, 9 Drawing Figures

TRANSFER-PRINTING SHEET SEPARATING SYSTEM FOR ELECTROPHOTOGRAPHIC COPYING APPARATUS

FIELD AND BACKGROUND OF THE INVENTION

This invention relates to a transfer-printing sheet separating system for an electrophotographic copying apparatus for separating from the photosensitive member a transfer-printing sheet fed by the sheet feeding device to the photosensitive member formed on its surface with a toner image to print the toner image on the transfer-printing sheet, and a method for effecting registration of the transfer-printing sheet with the toner image on the photosensitive member.

When the toner image on the surface of the photosensitive member is printed on the transfer-printing sheet, the transfer-printing sheet is electrostatically attracted to the surface of the photosensitive member, so that difficulties are encountered in separating the transfer-printing sheet from the surface of the photosensitive member after printing of the image is completed. Various proposals have hitherto been made to use various systems for separating the transfer-printing sheet from the surface of the photosensitive member.

In one method known in the art, pneumatic separation means is used for blowing air against the transfer-printing sheet to separate same from the photosensitive member. This method has a disadvantage in that since the toner image printed on the transfer-printing sheet is not fixed when the transfer-printing sheet is separated from the photosensitive member, the toner may be scattered by the stream of air blown against the sheet and adhere to the parts of the copying apparatus.

In another method known in the art, separating claws are slid between the photosensitive member and the transfer-printing sheet. In this method, the separating claws in the form of knife edges are maintained in contact with the surface of the rotating photosensitive member at all times, so that damage, in the form of parallel lines, tends to be caused to the surface of the photosensitive member. When the copying process is that of a negative/positive system, the duplicate or copy so produced will have dark lines thereon if the photosensitive member is damaged as aforesaid, thereby reducing the quality of the copy. Also, when the forward edges of the separating claws are deformed as by prolonged use, it would become impossible to separate the transfer-printing sheet from the photosensitive member satisfactorily.

In still another method of the prior art wherein the charge on the transfer-printing sheet is neutralized by AC corona discharge, the end of separating the transfer-printing sheet from the photosensitive member cannot be attained depending on the ambient conditions, such as temperature and humidity, the quality and thickness of the transfer-printing sheet, and other conditions.

In still another method known in the art, a belt or other separating member is positioned beforehand on one portion of the photosensitive member. This method has disadvantages. When the belt is of a stationary type, wear would be caused on the photosensitive member. Since the position of the belt is constant, the method can be used when the transfer-printing sheet is set in a position by using only one side as a reference, but cannot be used when setting of the transfer-printing sheet is effected by using the center of the photosensitive drum as a reference. In addition, the transfer-printing sheet of a large width could not be separated satisfactorily.

A system for drawing the transfer-printing sheet by vacuum has been proposed. This system requires means for creating vacuum, thereby increasing the size and cost of the copying apparatus.

SUMMARY OF THE INVENTION

This invention has as its object the provision of a transfer-printing sheet separating system, obviating the aforesaid disadvantages of the systems for separating a transfer-printing sheet from a photosensitive member of the prior art, which enables a transfer-printing sheet to be positively removed from the photosensitive member without adversely affecting on the copying apparatus and the reproduced image, and a method of bringing the leading end of the transfer-printing sheet into registration with the leading end of the toner image, on the photo-sensitive member in the copying apparatus provided with the aforesaid system, for separating the transfer-printing sheet from the photosensitive member.

The aforesaid object is accomplished according to the invention by providing, in a copying apparatus of the type described in the introductory part of the specification, a device for bending the leading end portion of a transfer-printing sheet in a path of travel of the transfer-printing sheet between the sheet feeding device and the transfer-printing station, the device for bending the leading end portion of the transfer-printing sheet being actuated in synchronism with the movement of the leading end portion of the transfer-printing sheet through the bending device, to thereby bend the leading end portion of the transfer-printing sheet in a direction in which the transfer-printing sheet is separated from the photosensitive member.

In a preferred form, the device for bending the leading end portion of a transfer-printing sheet comprises soft rollers formed of a soft material, and rotary members positioned against the soft rollers, the rotary members each being formed at the forward end with an edge angle parallel to the axis of the rotary member. When inoperative, the forward ends of the rotary members are spaced apart from the soft rollers; and when operative, the forward ends of the rotary members bite into the soft rollers in synchronism with the movement of the leading end portion of a transfer-printing sheet along the path between the soft rollers and the rotary members, to thereby fold the leading end portion of the transfer-printing sheet.

Preferably, the follower roller of the registration roller is moved away from the associated soft roller or have its conveying force lessened with respect to the transfer-printing sheet when the forward ends of the rotary members press against the soft rollers.

Preferably, the opposite ends of each rotary member are disposed outwardly of the opposite ends of the corresponding soft roller, to avoid the damage which might be caused by the rotary members to the soft rollers.

When a transfer-printing sheet having its leading end portion bent by the aforesaid embodiment of the device for bending the leading end portion of the transfer-printing sheet in conformity with the invention has its leading end portion separated from the surface of the photosensitive member, it is possible to positively separate the transfer-printing sheet without the separating device being brought into contact with the surface of the photosensitive member, thereby avoiding the damage that might be caused by the contact of the separating device with the photosensitive member.

According to the invention, the leading end portion of a transfer-printing sheet can be bent in a direction in which the transfer-printing sheet is separated from the periphery of the photosensitive member, by a simple construction. The need to use separating members having shart edges maintained in contact with the periphery of the photosensitive member at all times is eliminated. Thus, the transfer-printing sheet can be positively separated from the photosensitive member without causing any damage to the latter, thereby avoiding production of copies of low quality having black lines thereon. In addition, the object of separating a transfer-printing sheet can be accomplished without increasing the cost of the copying apparatus or producing unacceptable copies as contrasted with the use of air blowing means or vacuum means of the prior art for separating a transfer-printing sheet from the photosensitive member.

The invention also makes it possible to feed a transfer-printing sheet to a transfer-printing station in a timed relationship such that the leading end of the transfer-printing sheet is in registration with the leading end of an image on the photosensitive member at the transfer-printing station.

Additional and other objects, features and advantages of the invention will become more apparent from the description of the embodiments set forth hereinafter when considered in conjunction with the accompanying drawings, in which:

DETAILED DESCRIPTION

Figure 1:
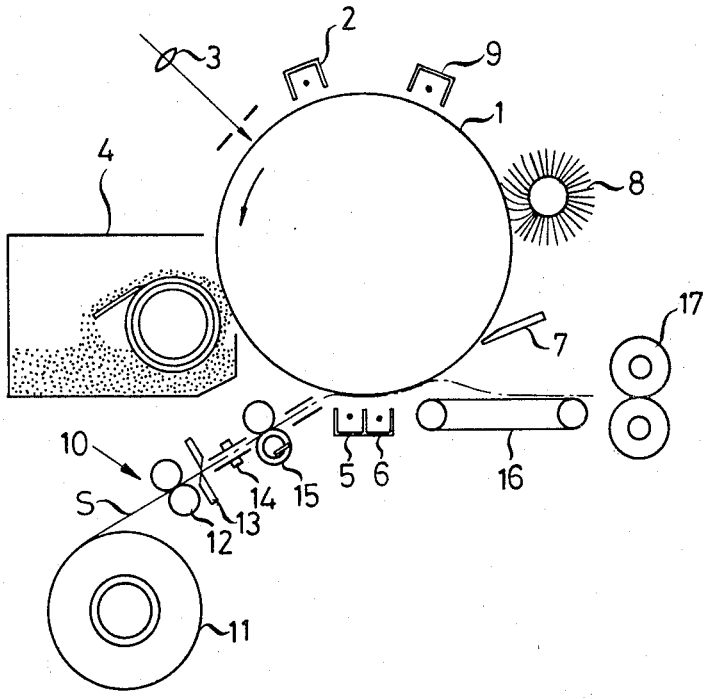
FIG. 1 is a schematic view of an example of the electrophotographic copying apparatus incorporating therein the device for separating a transfer-printing sheet from the photosensitive member according to the invention.

Embodiments of the invention will now be described by referring to the drawings. In FIG. 1, a photosensitive drum 1 rotates counterclockwise at a constant peripheral velocity and has, arranged along its periphery, a charging device 2, an exposing device 3, a developing device 4, a transfer-printing device 5, an AC corona discharging device 6, separating means 7, a cleaning device 8 and a charge removing device 9. A sheet feeding device 10 for feeding sheets from a web of paper, in roll form feeds transfer-printing sheets from a roll 11. Arranged in the path of travel of the transfer-printing sheets are sheet feeding rollers 12, cutter means 13, a transfer-printing sheet detecting device 14, a device 15 for bending the leading end portion of a transfer-printing sheet, a conveyor belt 16 and fixing rollers 17 disposed in the indicated order. The photosensitive drum 1 is uniformly charged by the charging device 2 and exposed to an optical image of an original by the exposing device 3, to form an electrostatic latent image thereon. The electrostatic latent image is converted into a toner image by the developing device 4. The photosensitive drum 1 is brought into intimate contact with the transfer-printing device 5, after passing through the developing device 4. The web of paper is payed out of the roll 11 in a predetermined length and cut by the cutter means 13 into predetermined lengths to provide transfer-printing sheets S. After the leading end of a transfer-printing sheet S has passed through the cutter means 13, the leading end is detected by the transfer-printing sheet detecting device 14 comprising light emanating elements and light receiving elements disposed in spaced juxtaposed relation on opposite sides of the path of travel of the transfer-printing sheet S. Microswitches and the like may be used for detecting the transfer-printing sheets.

Figure 2:
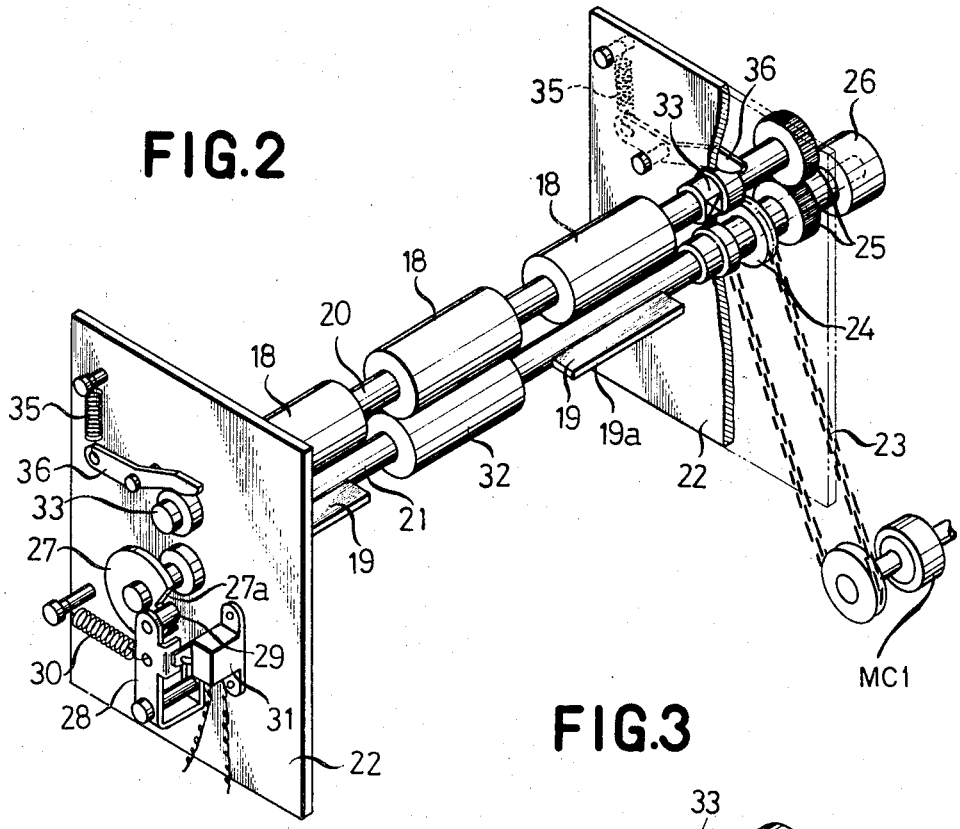
FIG. 2 is a perspective view of a first embodiment of the device for bending the leading end portion of a transfer-printing sheet in conformity with the invention.

The device 15 for bending the leading end portion of a transfer-printing sheet is shown in detail in FIG. 2. The device 15 includes rotary means including a plurality of rollers 18 formed of soft material mounted on a shaft 20 and a plurality of rotary members 19, each including a forward end portion 19*a* having a relatively sharp edge angle mounted on a shaft 21, which are supported by side walls 22 at opposite ends thereof. The soft rollers 18 and rotary members 19 are disposed perpendicular to the direction of movement of the transfer-printing sheet S and the path of travel of the sheet S is interposed therebetween. The forward ends 19*a* of the rotary members 19 are normally spaced apart from the soft rollers 18. The shaft 20 is driven through a sprocket wheel 24 and gears 25, the sprocket wheel 24 being driven through a chain 23 by a drive shaft, not shown, which begins to rotate as a clutch, not shown is engaged responsive to a sheet feeding signal. The shaft 21 is connected to a shaft of the sprocket wheel 24 through a clutch 26 mounted at one end of the shaft 21. A disk cam 27 formed with a V-shaped groove 27*a* is mounted at the other end of shaft 21, and a roller 29 supported at one end of an arm 28 is adapted to be urged by the biasing force of a spring 30 into engagement with the V-shaped groove 27*a*. When the rotary members 19 are spaced apart from the soft rolls 18 as described hereinabove, the roller 29 is in engagement with the groove 27*a* to place shaft 21 in a predetermined position. The arm 28 is supported at the other end thereof by one of the side plates 22. A switch 31 is mounted on the side plate 22 adjacent the arm 28. At least one follower roller 32 is supported by the shaft 21 in addition to the rotary members 19 and kept in contact with one of the soft rollers 18 supported by the shaft 20 for rotation following up the soft roller 18.

Figure 8:
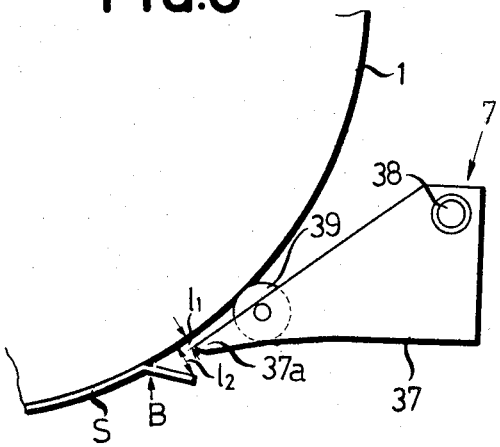
FIG. 8 is a side schematic view of a separating claw member of the means for separating a transfer-printing sheet the leading end thereof is bent by the device in conformity with the invention.
Figure 9:
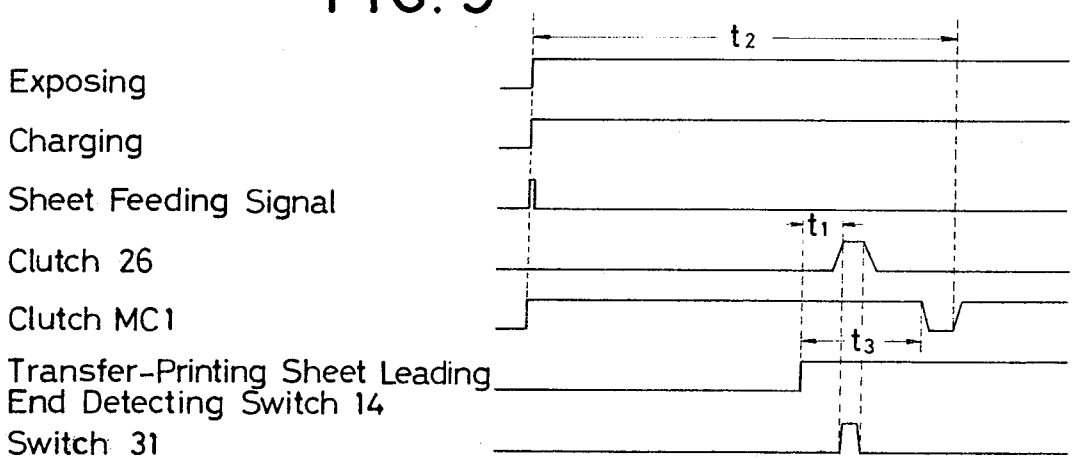
FIG. 9 is a timing chart for carrying into practice a method of bringing the leading end of a transfer-printing sheet into registration with the leading end of an image on the photo-sensitive member by using the first embodiment of the device for bending the leading end portion of a transfer-printing sheet shown in FIG. 2.

The separating claw means 7 for separating the transfer-printing sheet S from the photosensitive drum 1 after the toner image on the drum 1 is printed on the sheet S comprises a separating claw 37, a shaft 38 and a roller 39 rotatably supported at the forward end portion of the separating claw 37, as shown in FIG. 8. The separating claw 37 is urged by the biasing force of a spring or a weight, not shown, to move clockwise about the shaft 38. The roller 39 at the forward end portion of the separating claw 37 is brought into gentle contact with the periphery of the photosensitive drum 1 by the clockwise movement of the separating claw 37. Serving as a spacer, the roller 39 keeps a forward end 37*a* of the separating claw 37 away from the photosensitive drum 1 a predetermined distance $l_1$ at all times. The roller 39 may be replaced by a spherical member.

Figure 4:
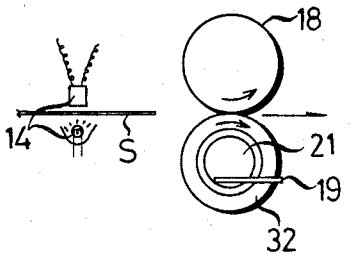
FIGS. 4, 5 and 6 are schematic views in explanation of the operation of the device for bending the leading end portion of a transfer-printing sheet shown in FIG. 2.
Figure 5:
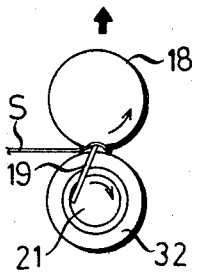
Figure 6:
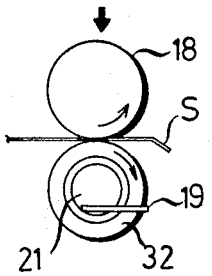

In operation, the transfer-printing sheet S is fed by the sheet feeding rollers 12, and this rotates the soft rollers 18 and follower roller 32 as shown in FIG. 4 through the chain 23, sprocket wheel 24 and shaft 20. As the leading end of the transfer-printing sheet S fed by the feeding rollers 12 approaches the device 15 for bending the leading end portion of the transfer-printing sheet and is detected by the detecting device 14, the clutch 26 is engaged at once or after lapse of a predetermined time interval, rotates the shaft 21 in synchronism with the movement of the transfer-printing sheet S. When a predetermined position in the leading end portion of the transfer-printing sheet S in which bending is to be effected moves to the position of the soft rollers 18, the forward ends 19*a* of the rotary members 19 having the edge angle move to a position in which they abut against the undersurface of the transfer-printing sheet S as shown in FIG. 5 and force the sheet S against the soft rollers 18, so that the sheet S is bent in such a manner that the undersurface thereof is wedged against the soft rollers 18. As the rotary members 19 make one complete revolution and return to the original position as shown in FIG. 6, the roller 29 is moved by the biasing force of spring 30 into engagement with the V-shaped groove 27*a* of the cam 27 as shown in FIG. 2. At the same time, the switch 31 is actuated to disengage the clutch 26, thereby interrupting rotation of the shaft 21 and positioning the same via the V-shaped groove 27*a* and roller 29. That is to say, members 27–31 comprises a one turn clutch. The transfer-printing sheet S having its leading end portion bent in this way is fed to the transfer-printing device 5 by the soft rollers 18 and the follower roller 32 as shown in FIG. 6.

After printing of the toner image on the transfer-printing sheet S is completed and the charge is neutralized by the AC corona discharging device 6, the separating claw 37 has its forward end 37*a* introduced between the bent leading end portion of the transfer-printing sheet S and the periphery of the photosensitive drum 1, so that the transfer-printing sheet S is successively separated from the periphery of the photosensitive drum 1 as the sheet S is moved. The separated sheet S is forwarded by the conveyor device 16 to the fixing device 17.

Figure 7:
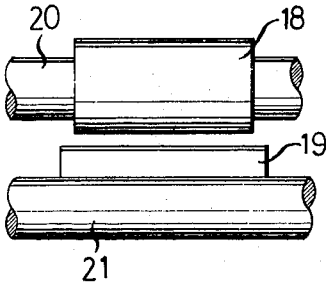
FIG. 7 is a schematic view showing the axial relative positions of the soft roller and the rotary member of the embodiment shown in FIG. 2.

The rotary members 19 have a length larger than the soft rollers 18 as shown in FIG. 7 to avoid the soft rollers 18 being caught and broken by the edges of the opposite ends of the rotary members 19 during rotation. The opposite ends of the rotary members 19 are preferably long enough to be disposed slightly outwardly of the opposite ends of the associated soft rollers 18.

Figure 3:
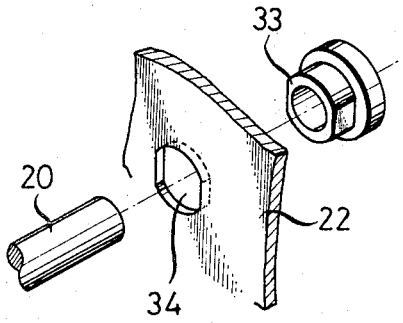
FIG. 3 is an exploded perspective view of the bearing portion of a roller shaft.

While the forward ends 19*a* of the rotary members 19 are pressing the transfer-printing sheet S against the soft rollers 18, the path of movement of portions of the transfer-printing sheet S held between the rotary member forward ends 19*a* and the soft rollers 18 is greater in length than the path of movement of a portion of the transfer-printing sheet S held between the registration rollers, i.e. follower roller 32 and the soft roller 18 with respect to the same rotational angle of the shaft 21. Thus, if the rollers 18 and follower roller 32 are operated simultaneously, the transfer-printing sheet S would possibly be wrinkled and a copy of high quality would be unobtainable. To avoid this phenomenon, it is necessary either to move the soft roller 18 associated with the follower roller 32, upwardly out of engagement with follower roller 32 to a degree such that no influence is exerted on bending of the transfer-printing sheet S while the sheets is being pressed against the soft rollers 18 or to reduce the pressing force exerted by the soft roller 18 to a degree such that the transfer-printing sheet S slips. To this end, openings 34 formed in the side plates 22 for receiving bearings 33 for the shaft 20 are elliptic in shape as shown in FIG. 3, so that when the bearings 33 move slightly the spacing between the shafts 20 and 21 is varied to bring the soft roller 18 out of engagement with the follower roller 32 or to reduce the pressing force exerted by the soft roller 18. Each of the bearings 33 is urged by the biasing force of a spring 35 through a forward end of an arm 36 supported by the side plate 22 to move toward the shaft 21. Normally, a pressure suitable for allowing the follower roller 32 to rotate in following-up movement is imparted to the soft roller 18. However, when the leading end portion of the transfer-printing sheet S is introduced into the device 15 and pressed by the forward ends 19*a* of the rotary members 19 against the soft rollers 18, the pressing force exerted by the rotary members 19 moves the shaft 20 upwardly through the soft rollers 18 against the biasing force of springs 35. The movement brings the soft roller 18 out of engagement with the follower roller 32, or reduces the force exerted by the soft roller 18 on the follower roller 32. Accordingly, the portion of the transfer-printing sheet S between the rollers 18 and 32 is not restrained and moves a distance of the same length as the distance covered by the movement of the portions of the sheet S which are bent. This is conducive to prevention of wrinkle formation in the transfer-printing sheet S. By suitably reducing the distance covered by the movement of the bearings 33, to a distance below the depth to which the rotary members 19 bite into the soft, rollers 18, it is possible to enable bending of the transfer-printing sheet S by the rotary members 19 to be effected without any trouble.

In this fashion, the transfer-printing sheet S is bent at its forward end portion with the undersurface thereof being wedged, and the leading end portion of the sheet S is spaced apart from the periphery of the photosensitive drum 1 a distance $l_2$ as shown in FIG. 8 when the sheet S is electrostatically maintained in contact with the drum 1 during a printing operation. By setting the distance $l_1$ between the forward end 37*a* of the separating claw 37 and the photosensitive drum 1 at a value smaller than that of the distance $l_2$, it is possible to enable the forward end 37*a* of the separating claw 37 to enter between the transfer-printing sheet S and the drum 1, to thereby positively separate the former from the latter. The separating claw means 7 is located in a position corresponding to the portion of the transfer-printing sheet S which is bent by the rotary members 19 of the sheet bending device 15. When the leading end portion of the transfer-printing sheet S is bent along its entire width, the separating claw means 7 may be arranged in any position as desired.

The device shown in FIG. 2 may concurrently have the function of bringing the leading end of the transfer-printing sheet S into registration with the leading end of the image on the photosensitive drum 1 at the transfer-printing station. In a timing chart shown in FIG. 17 showing the timing of operation of various devices shown in FIGS. 1 and 2, the charging device 2 and the exposing device 3 are rendered operative upon receipt of a copying initiation signal. Assume that after lapse of a predetermined time interval $t_2$, the distance between the leading end of the image formed on the photosensitive drum 1 and the transfer-printing device 5 becomes equal to the distance between the leading end of the transfer-printing sheet S stationary at the transfer-printing sheet bending device 15 and the transfer-printing device 5. The copying initiation signal is a sheet feeding signal. Production of the sheet feeding signal engages the clutch MC1, described by referring to the first embodiment, to drive the gears 25 though the chain 23, so that the soft rollers 18 on the shaft 20 rotate. Upon detection of the transfer-printing sheet S by the transfer-printing sheet detecting device 14, the clutch 26 is engaged after lapse of a time interval $t_1$ to rotate the shaft 21 ($t_1$ may be 0). As a result, the leading end portion of the transfer-printing sheet S is bent. One complete revolution of the rotary members 19 on shaft 21 simultaneously turns off the switch 31 and turns on the switch 31, thereby disengaging the clutch 26. This brings the rotary members 19 to a halt, but the clutch MC1 is still engaged so that the soft rollers 18 continue to rotate to thereby move the transfer-printing sheet S. After lapse of a time interval $t_3$ following detection of the leading end of the transfer-printing sheet S by the detecting device 14, the clutch MC1 is disengaged, thereby bringing the soft rollers 18 to a halt. Thus the transfer-printing sheet S temporarily becomes stationary. However, the photosensitive drum 1 continued its rotation, and after lapse of the time $t_2$ following production of the sheet feeding signal, the clutch MC1 is engaged again to drive the soft rollers 18 to rotate. This starts feeding of the transfer-printing sheet S to the photosensitive drum again. The time intervals $t_1$, $t_2$ and $t_3$ may be set by using a counter for counting the number of pulses, an electric counter or a mechanical timer. In this way, the transfer-printing sheet S can be fed correctly in synchronism with the rotation of the photosensitive drum 1.

In the foregoing description, the leading end of a transfer-printing sheet has been described as being brought into registration with the leading end of an image on the photosensitive drum in all the embodiments. However, strictly speaking, it would serve no useful purpose to literally bring the two leading ends into registration with each other, because as shown in FIG. 8 the bent leading end portion of the transfer-printing sheet is not in contact with the drum 1 and no portion of the image is printed on the leading end portion of the transfer-printing sheet S which is out of contact with the drum. Thus what is necessary is to feed the transfer-printing sheet S in a timing such that the bend (indicated at B in FIG. 8) of the transfer-printing sheet S is brought into registration with the leading end of the image on the photosensitive drum.

Although the invention has been described by referring to preferred embodiments thereof, it is to be understood that the invention is not limited to the specific forms of the embodiments described and that many changes and modifications may be made therein without departing from the scope of the invention. For example, the photosensitive member may be in the form of a belt, not in the form of a drum as shown and described. The transfer-printing of an image may be the system of printing an electrostatic latent image. The sheet feeding may be effected by using a cassette containing sheets of the desired size, in place of cutting a web of paper payed out of a roll into desired lengths by cutter means.

What is claimed is:

1. In an electrophotographic copying apparatus of the type having a sheet feeding device for pressing a transfer printing sheet through a feed path to the surface of a photosensitive member having a toner image formed thereon, the toner image being printed on the transfer-printing sheet from the photosensitive member at a transfer-printing station, and means for separating the transfer-printing sheet having the toner image printed thereon from the photosensitive member, an improved transfer-printing sheet separating system comprising:

a device for bending a leading end portion of the transfer-printing sheet located in the feed path of the transfer-printing sheet between the sheet feeding device and the transfer-printing station; and means for actuating the device for bending the leading end portion of the transfer-printing sheet in synchronism with the passing of the leading end of the transfer-printing sheet, said device for bending the leading end portion of the transfer-printing sheet comprises soft rollers and rotary members disposed in juxtaposed relation on opposite sides of the feed path of the transfer-printing sheet, said rotary members each being formed at a forward end with an edge angle parallel to the axis of the rotary member, said forward ends of said rotary members being spaced apart from the soft rollers when said device is inoperative and brought into engagement therewith when the device is operative, whereby the edge-angled forward ends of the rotary members bite into the soft roller to form a bend in the leading end portion of the transfer-printing sheet held between the soft roller and the rotary members, wherein said device for bending the leading end portion of the transfer-printing sheet further comprises at least one follower roller supported coaxially with the rotary members for rotation responsive to the rotation of the soft rollers.

2. A transfer-printing sheet separating system as claimed in claim 1, further comprising means for moving said soft rollers away from said follower roller or reducing the force with which the soft roller presses against said follower roller when the forward ends of said rotary members force the transfer-printing sheet against said soft rollers.

3. In an electrophotographic copying apparatus of the type having a sheet feeding device for pressing a transfer printing sheet through a feed path to the surface of a photosensitive member having a toner image formed thereon, the toner image being printed on the transfer-printing sheet from the photosensitive member at a transfer-printing station, and means for separating the transfer-printing sheet having the toner image printed thereon from the photosensitive member, an improved transfer-printing sheet separating system comprising:

a device for bending a leading end portion of the transfer-printing sheet located in the feed path of the transfer-printing sheet between the sheet feeding device and the transfer-printing station; and means for actuating the device for bending the leading end portion of the transfer-printing sheet in synchronism with the passing of the leading end of the transfer-printing sheet, said device for bending the leading end portion of the transfer-printing sheet comprises soft rollers and rotary members disposed in juxtaposed relation on opposite sides of the feed path of the transfer-printing sheet, said rotary members each being curved in a suitable curvature at a forward end, the forward ends of the rotary members being spaced apart from the soft rollers when the device is inoperative and brought into engagement therewith when the device is operative, whereby the forward ends of the rotary members bite into the soft rollers to curve in a suitable curvature the leading end portion of the transfer-printing sheet held between the soft rollers and the rotary members, wherein said device for bending the leading end portion of the transfer-printing sheet further comprises at least one follower roller supported coaxially with the rotary members for rotation responsive to the rotation of the soft rollers.

4. A transfer-printing sheet separating system as claimed in claim 3, further comprising means for moving said soft rollers away from said follower roller or reducing the force with which the soft roller presses against said follower roller when the forward ends of said rotary members force the transfer-printing sheet against said soft rollers.

* * * * *